US006626524B2

(12) United States Patent
Okazawa et al.

(10) Patent No.: US 6,626,524 B2
(45) Date of Patent: Sep. 30, 2003

(54) INK JET RECORDING HEAD PROVIDED WITH A VIBRATOR UNIT

(75) Inventors: Noriaki Okazawa, Nagano (JP); Hiroshige Owaki, Nagano (JP); Tsuyoshi Kitahara, Nagano (JP); Tomoaki Takahashi, Nagano (JP); Takayuki Iijima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/968,281

(22) Filed: Oct. 2, 2001

(65) Prior Publication Data

US 2002/0044179 A1 Apr. 18, 2002

(30) Foreign Application Priority Data

| | | |
|---|---|---|
| Oct. 2, 2000 | (JP) | P.2000-302036 |
| Oct. 2, 2000 | (JP) | P.2000-302037 |
| Jan. 11, 2001 | (JP) | P.2001-003740 |
| Sep. 26, 2001 | (JP) | P.2001-293251 |

(51) Int. Cl.[7] ..... B41J 2/045
(52) U.S. Cl. ..... 347/68
(58) Field of Search ..... 347/68, 70–72

(56) References Cited

FOREIGN PATENT DOCUMENTS

| | | | |
|---|---|---|---|
| EP | 0 694 389 A2 | 1/1996 | |
| EP | 0 931 650 A1 | 7/1999 | |
| EP | 0 982 135 A2 * | 3/2000 | ..... B41J/2/14 |
| EP | 1 020 292 A2 | 7/2000 | |
| EP | 1 145 853 A1 * | 10/2001 | ..... B41J/2/14 |

OTHER PUBLICATIONS

Japanese Patent Abstract No. 10315462 dated Dec. 2, 1998.

* cited by examiner

*Primary Examiner*—Judy Nguyen
(74) *Attorney, Agent, or Firm*—Sughrue Mion, PLLC

(57) ABSTRACT

In a vibrator unit, at least one piezoelectric vibrator is fixed on a base member in a cantilevered manner, such that a first region of the piezoelectric vibrator is fixed on a first face of the base member. A resin case is formed with a housing space extending through a first end face to a second end face thereof. The housing space includes a first housing part which opens to the first end face of the case, a second housing part which continues to the first housing part, and a third housing part which continues to the second housing part. In the first housing part, a part of the piezoelectric vibrator except for the first region is housed. The second housing part is defined by a first inner face extending in a first direction which is parallel with an extending direction of the piezoelectric vibrator, on which a first part of a second face of the base member which is opposite to the first face is bonded, and a second inner face extending in a second direction which is perpendicular to the first direction, on which a part of a third face which connects the first face and the first part of the second face is bonded. The third housing part is isolated from a part of the base member which includes a second part of the second face.

20 Claims, 14 Drawing Sheets

INK JET RECORDING HEAD PROVIDED WITH A VIBRATOR UNIT

BACKGROUND OF THE INVENTION

The present invention relates to an ink jet recording head to be suitably used for a recording apparatus such as a printer or a plotter, and more particularly to an ink jet recording head comprising a case formed of resin which can accommodate a vibrator unit and a channel unit to be bonded to the distal end of the case.

A related ink jet recording head (which will be hereinafter referred to as a recording head) employs such a structure as to have a vibrator unit bonding a piezoelectric vibrator row to a fixation base, a case formed of resin which forms a housing space capable of accommodating the vibrator unit, and a channel unit to be bonded to the distal end portion of the case.

For example, the channel unit includes a nozzle plate having a plurality of nozzle orifices provided in a row, a channel forming substrate provided with an ink channel communicating with the nozzle orifice from a common ink reservoir via a pressure chamber, and an elastic plate for sealing one of the openings of the pressure chamber and the common ink reservoir, and is fabricated by integrating each of the members in a lamination state. The channel forming substrate is fabricated by etching a silicon wafer. A nozzle plate formed of stainless steel (SUS) is bonded to one face of the channel forming substrate, and the elastic plate is bonded to the other face thereof. The elastic plate is constituted by a composite plate member in which a support plate formed of stainless steel, in which a stainless layer is partially removed to form an island portion, is laminated on a resin film, for example.

Moreover, the free end of each piezoelectric vibrator is exposed to the outside of the case through an opening on the distal end side of the housing space. A distal end face of each piezoelectric vibrator is bonded to the island portion formed in the elastic plate. The free end is extendable to deform the elastic plate so that the volume of the pressure chamber is variable. Furthermore, the fixation base of the vibrator unit is formed of stainless steel and is bonded through adhesion to the internal wall face of the case formed of resin.

When a recording head having such a structure is placed for a long time in very, high humid environment the case is swelled. For example, as shown in FIG. 15, a case 1 is wholly swelled with the moisture absorption of the resin constituting the case 1. As shown in FIG. 16, moreover, a channel unit 2 is bonded to the distal end face of the case 1. Since the channel unit 2 has a channel forming substrate formed of silicon and a nozzle plate formed of stainless steel, the swelling is not caused by the moisture absorption. For this reason, the distal end side of the case 1 is constrained by the channel unit 2 so that the amount of deformation is decreased, and the amount of deformation is increased as being distant from the channel unit 2. Accordingly, the proximal end side of the case 1 (that is, the attachment face side opposite to the channel unit 2) is greatly deformed.

Furthermore, since a fixation base 6 of a vibrator unit is also formed of metal such as stainless steel, the swelling is not caused by the moisture absorption. For this reason, the fixation base 6 and the case 1 which are bonded to each other deform due to the moisture absorption similarly to a bimetal phenomenon such that they are curved to be convex toward the outside of the case 1.

As a result, mechanical stress is applied to the bonding interface of a piezoelectric vibrator 3 and an island portion 4 and that of a resin film portion 5 and the island portion 4. More specifically, the fixation base 6 falls down toward the outside of the case 1 together with the case 1 so that the piezoelectric vibrator 3 also falls down. Consequently, mechanical stress is applied to the bonding interface. When the mechanical stress is excessively applied, the bonding interface is separated so that the recording head might be broken.

SUMMARY OF THE INVENTION

It is therefore an object of the present invention to enhance the connecting reliability of a piezoelectric vibrator unit.

In order to achieve the above object, according to the present inventions there is provided an ink jet recording head, comprising:

- a vibrator unit, in which at least one piezoelectric vibrator is fixed on a base member in a cantilevered manner, such that a first region of the piezoelectric vibrator is fixed on a first face of the base member; and
- a resin case, formed with a housing space extending through a first end face to a second end face thereof, the housing space including:
  - a first housing part, which opens to the first end face of the case, in which a part of the piezoelectric vibrator except for the first region is housed;
  - a second housing part, which continues to the first housing part, the second housing part defined by a first inner face extending in a first direction which is parallel with an extending direction of the piezoelectric vibrator, on which a first part of a second face of the base member which is opposite to the first face is bonded, and a second inner face extending in a second direction which is perpendicular to the first direction; on which a part of a third face which connects the first face and the first part of the second face is bonded; and
  - a third housing part, which continues to the second housing part, the third housing part being isolated from a part: of the base member which includes a second part of the second face.

Preferably, the recording head further comprises a channel unit which is provided on the first end face of the case such that free end face of the piezoelectric member is bonded thereon.

In the above configurations, the mechanical linkage of the base member and the case is eliminated in the third housing part, it is prevented the base member from inclining together with the swelling deformation of the resin case due to moisture absorption. Accordingly, it is possible to prevent the piezoelectric vibrator from separated from the base member due to mechanical stress application onto the bonding interface between the piezoelectric vibrator and the base member. As a result, it is possible to enhance the connecting reliability of the piezoelectric vibrator.

Preferably, the first part of the second face of the base member opposes to at least the first region of the piezoelectric vibrator.

In this configuration, it is secured a bonding region necessitately required for receiving reaction force with the motion of the piezoelectric vibrator. Consequently, it is possible to enhance the connecting reliability of the piezoelectric vibrator without damaging the jetting characteristic of ink drops.

Preferably, the second part of the second face of the base member is larger than the first part of the second face of the base member.

In this configuration, the base member can be easily held by a jig for mounting the vibrator unit into the case. Further, heat radiating effect can also be enhanced.

Preferably, inner wall faces of the case defining the third housing part is not bonded to the base member.

Here, it is preferable that the third housing part is defined by a third inner face extending from a boundary of the first part and the second part of the second face of the base member in the second direction, and a fourth inner face extending in the first direction to the second end face of the case.

In the above configurations, a part of the case formed with the third inner wall face acts to restrict the inclination of the base member due to the swelling. Furthermore, the space formed by the third and the fourth inner wall faces can be utilized to arrange components of the recording head in the space or can be utilized as a heat radiating space. Consequently, the degree of freedom for the design of the recording head can be increased.

Further, it is preferable that the recording head further comprises a circuit board mounted on the second end face of the case. An area defined by the third inner wall face is larger than a size of the circuit board.

Still further, it is preferable that a groove for holding ink therein is formed at a boundary of the third inner wall face and the fourth inner wall face.

Preferably, the case includes a flange member extending from the second and face thereof in the second direction. A positioning member is formed on a distal end portion of the flange member, which is abutted on a carriage member on which the recording head is mounted.

Preferably, the recording head further comprises a reinforcing plate member provided on a first part of an outer wall of the case the first part of the outer wall being a part opposing to at least the third housing part.

In this configuration, the swelling of the case due to moisture absorption can be restricted by the base member and the reinforcing plate member sandwiching the case therebetween. Therefore, the inclination of the base member due to the swelling deformation can be prevented more reliably.

Here, it is preferable that the reinforcing plate member extends so as not to extend to the first end face of the case.

Here, it is preferable that the reinforcing plate member extends to a position opposing to the second inner wall face of the case.

In the above configurations, a part of the case which is not covered by the reinforcing plate member is allowed to be swelled. Due to this swelling deformation, it is possible to reliably prevent such a drawback that the channel unit and the vibrator unit are separated in the first direction, thereby the connecting reliability of the piezoelectric vibrator can be enhanced.

Further, it is preferable that a Young's modulus of the reinforcing plate member is higher than a Young's modulus of the base member.

In this case, the reinforcing plate can be thinly fabricated so that the size of the recording head can be reduced.

Further, it is preferable that the base member and the reinforcing plate member are made of the same material.

In this case, the material characteristics of the reinforcing plate and the fixation base are equal to each other. Consequently, the easiness of the design can be obtained.

Here, it is preferable that a thickness of the reinforcing plate member is identical with a thickness of the base member.

Further, it is preferable that the reinforcing plate member is made of metal.

Here, it is preferable that the reinforcing plate member is made of stainless steel.

In this case, a necessary rigidity can be obtained while a processing can easily be carried out. Furthermore, it is also possible to efficiently radiate the heat of the recording head through the reinforcing plate. Moreover, there is no moisture permeability. Therefore, it is possible to prevent the swelling deformation of the case due to moisture absorption more reliably.

Preferably, the case is made of thermosetting resin.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION OF THE PREFERRED EMBODIMENTS

Preferred embodiments of the invention will be described below with reference to the accompanying drawings. First, the whole structure of a recording head will be described.

Figure 1:
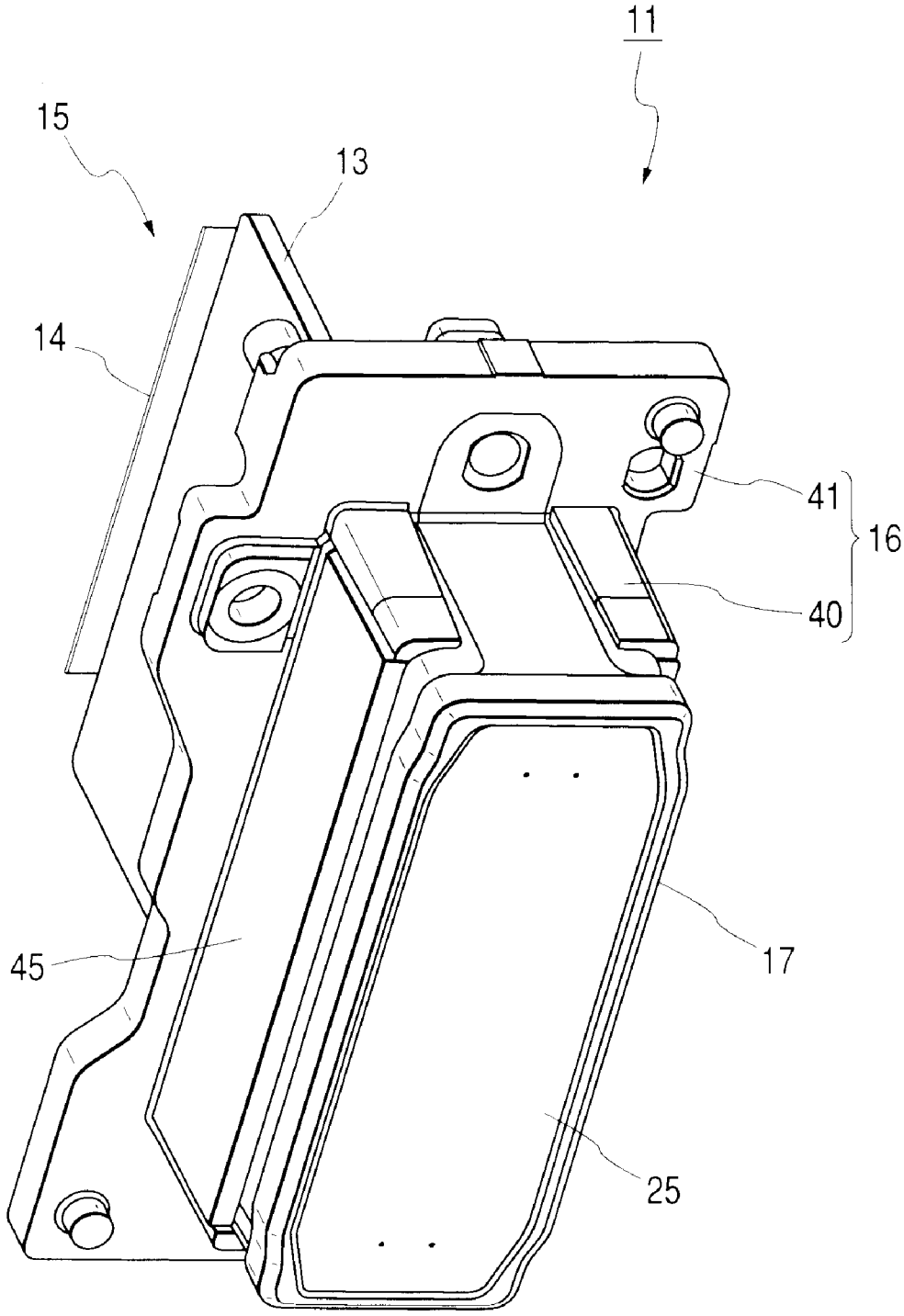
FIG. 1 is a perspective view showing a recording head according to a first embodiment of the invention, as seen from a nozzle plate.
Figure 2:
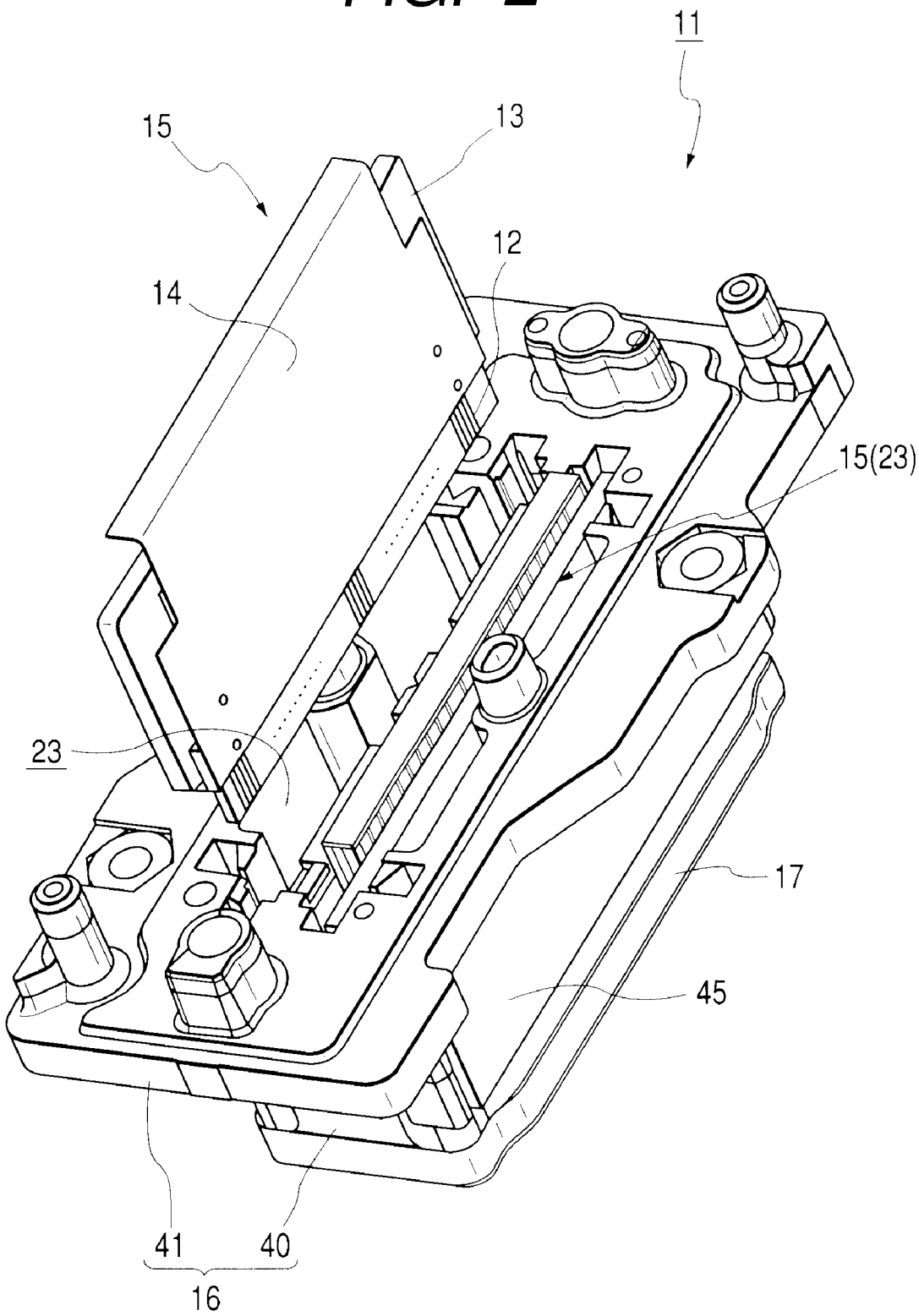
FIG. 2 is a perspective view showing the recording head as seen from a flange portion.

As shown in FIGS. 1 and 2, a recording head 11 comprises: a vibrator unit 15 having a piezoelectric vibrator row 12, a fixation base 13 and a flexible cable 14 which are integrated; a case 16 capable of accommodating the vibrator unit 15; and a channel unit 17 bonded to a distal end face of the case 16.

Figure 3:
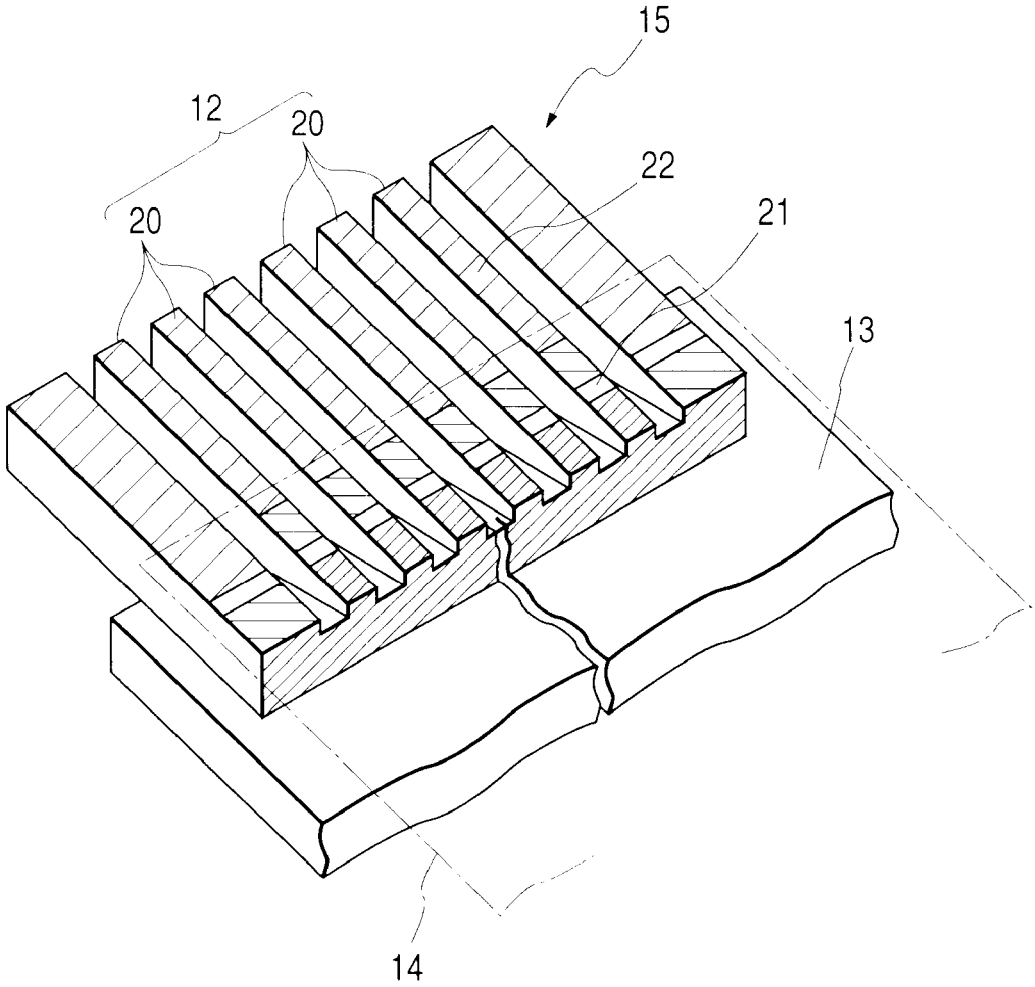
FIG. 3 is a perspective view showing a vibrator unit.

The vibrator unit 15 will be described. As shown in FIG. 3, a piezoelectric vibrator 20 constituting the piezoelectric vibrator row 12 is formed like an elongated comb tooth in a vertical direction, and is separately cut to have a very small width of approximately 50 to 100 $\mu$m, for example. The piezoelectric vibrator 20 is constituted as a piezoelectric vibrator of a vertical oscillation type which can be extended in the vertical direction. In each of the piezoelectric vibrators 20, a fixed end portion 21 is bonded onto the fixation base 13 so that a free end portion 22 is protruded outward from the distal end of the fixation base 13. More specifically, the piezoelectric vibrator 20 is supported on the fixation base 13 in a cantilevered manner. Moreover, the length of the fixed end portion 21 is determined so as to be shorter than the length of the fixation base 13. The fixed end portion 21 is bonded to the front portion (distal end portion) of the fixation base 13. In other words, the rear side portion of the fixation base 13 is provided up to a portion provided behind the rear end of the fixed end portion 21.

Figure 6:
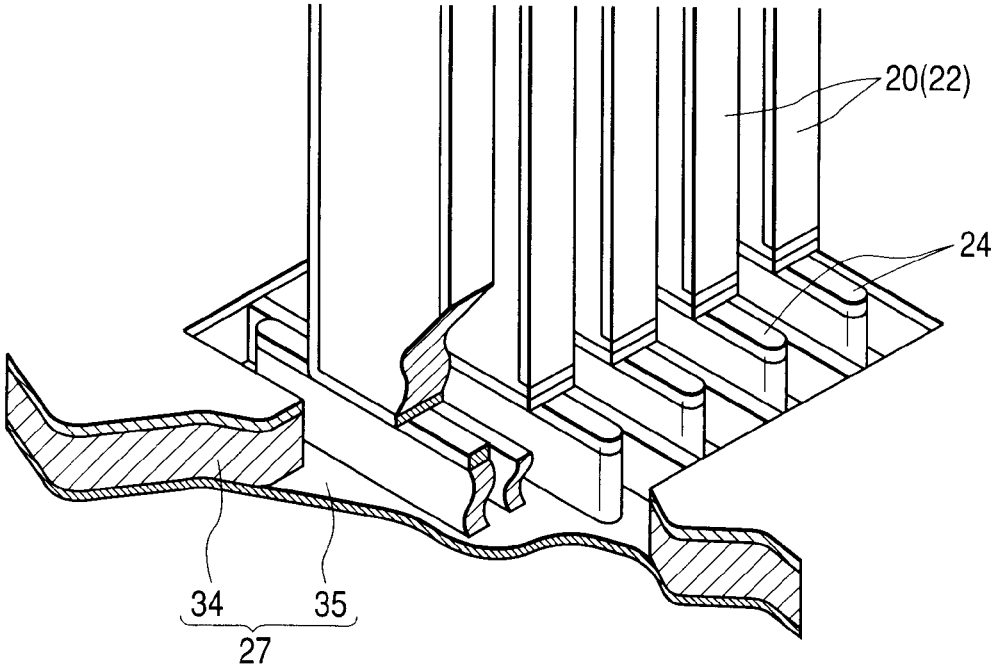
FIG. 6 is an enlarged perspective view showing a connecting portion of a piezoelectric vibrator and an island portion.

The distal end of the free end portion 22 in each of the piezoelectric vibrators 20 is bonded to an island portion 24 of the channel unit 17 as shown in FIG. 6.

The flexible cable 14 is electrically connected to the piezoelectric vibrator 20 on the side face of the fixed end portion 21 which is opposite to the fixation base 13. Moreover, the fixation base 13 supporting each of the piezoelectric vibrators 20 is constituted by a plate-shaped member including a rigidity capable of receiving reaction force from the piezoelectric vibrator 20, preferably, metallic plate member. In the embodiment, the fixation base 13 is formed of a stainless steel plate having a thickness of approximately 1 mm and is provided to have a greater shape than that of the bonding region of the fixation base 13 and a non-bonded wall portion 46 which will be described below.

Figure 8:
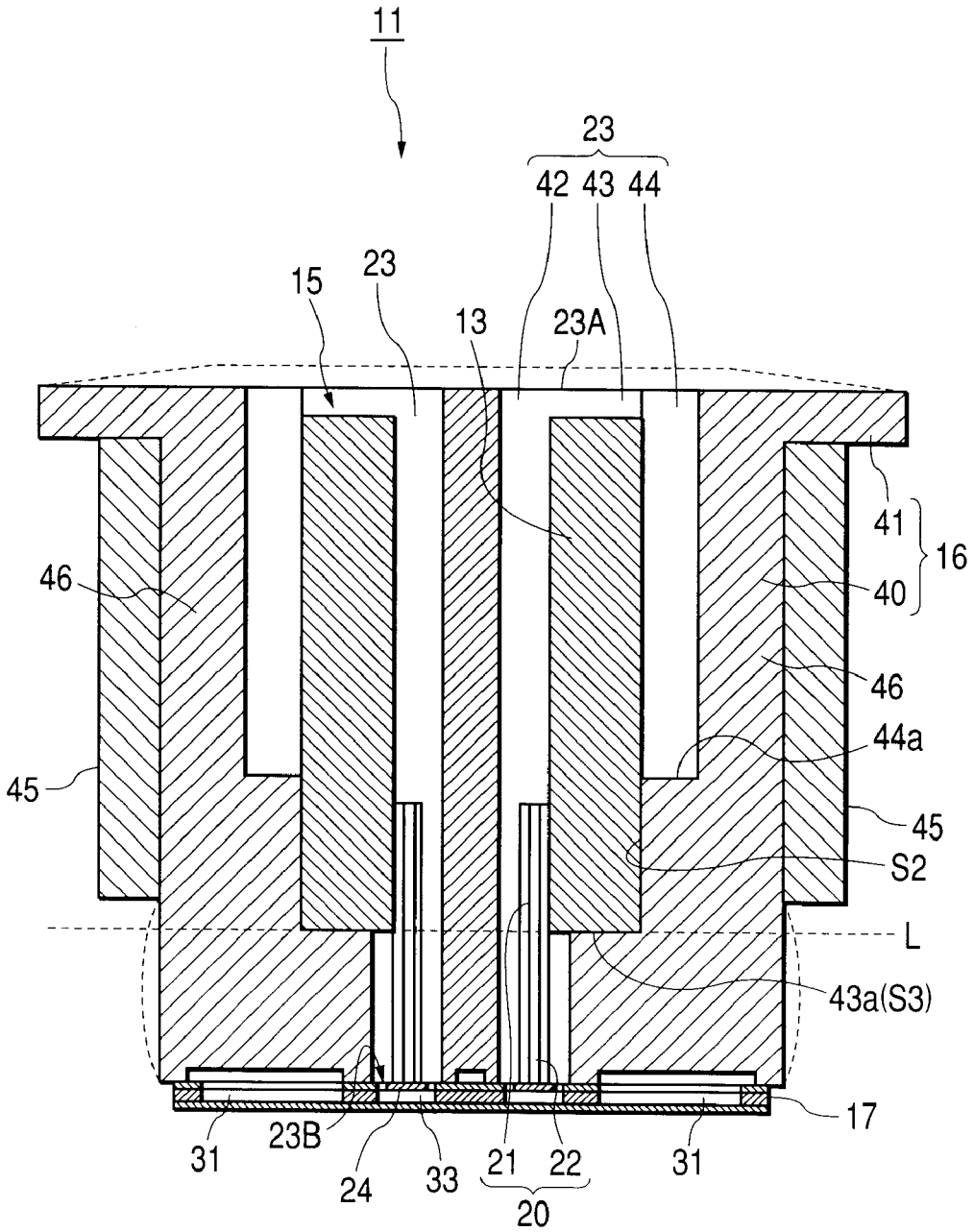
FIG. 8 is a section view showing the recording head.

As shown in FIG. 8, the length of the fixation base 13 is determined such that a rear end face (proximal end side face) is positioned in the vicinity of a proximal end opening 23A (which will be described below) of a housing space 23 when the vibrator unit 15 is placed therein. Consequently, the fixation base 13 can be held by a jig when the attachment of the vibrator unit 15 is performed. Further, heat radiation can also be enhanced.

Figure 4:
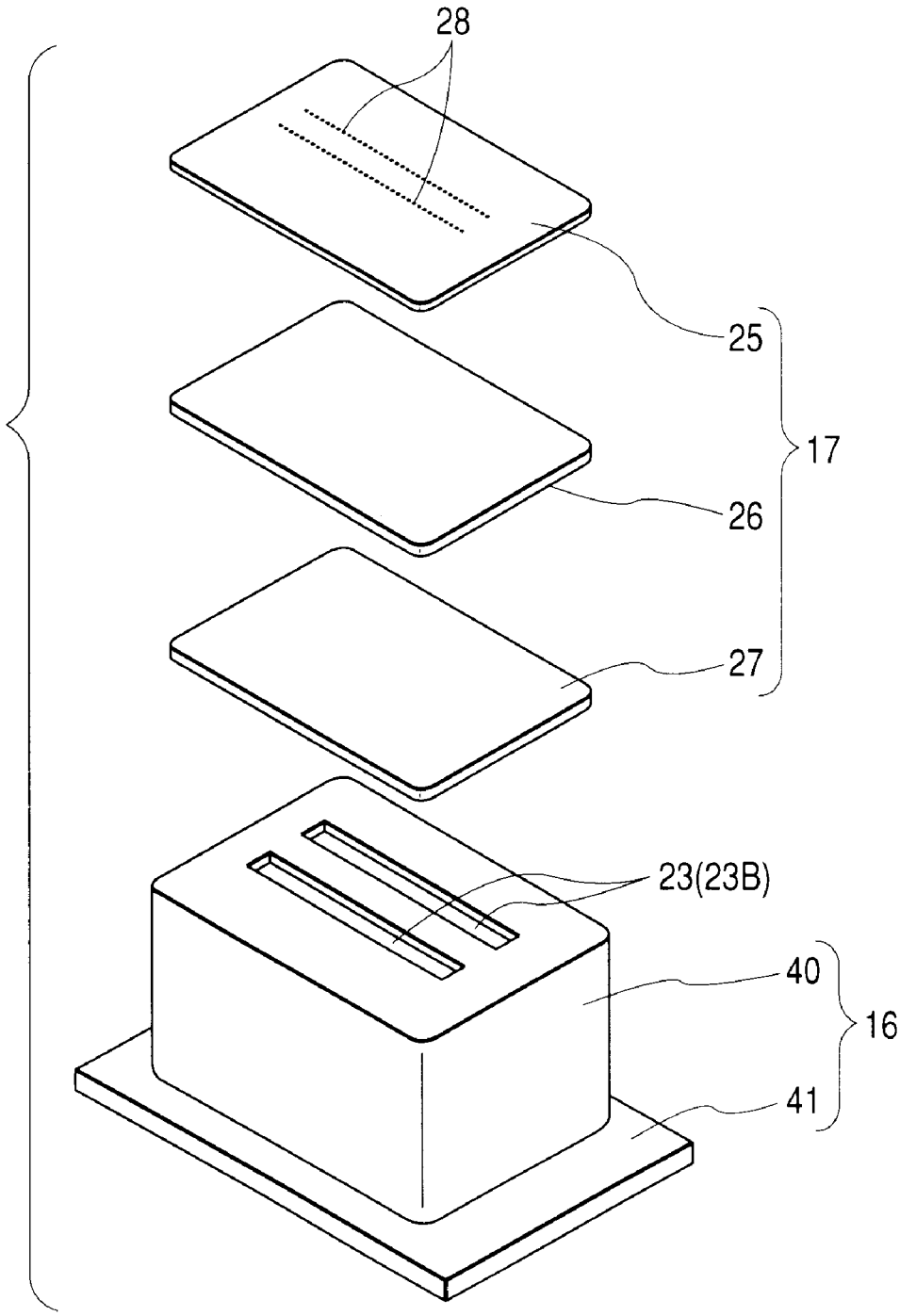
FIG. 4 is an exploded perspective view showing the recording head.
Figure 5:
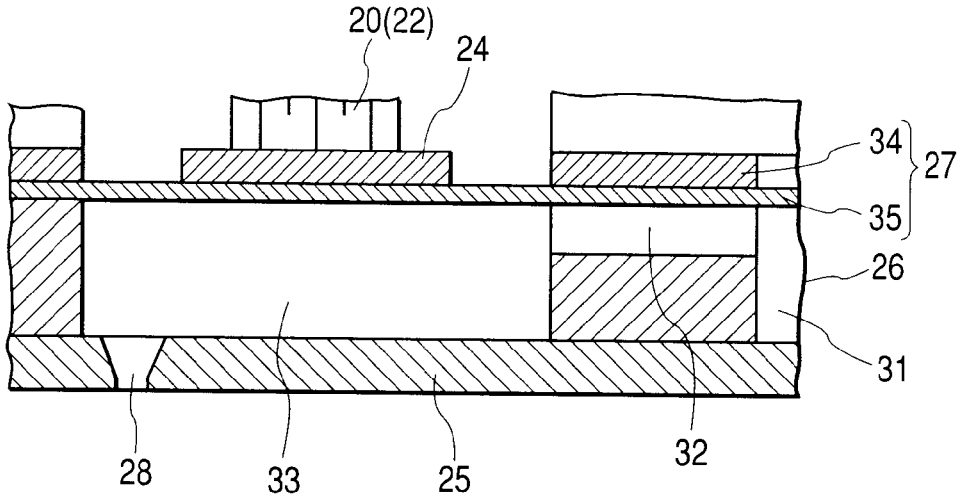
FIG. 5 is an enlarged section view showing a part of a channel unit.

Next, the channel unit 17 will be described. As shown in FIGS. 4 and 5, the channel unit 17 is constituted by a nozzle plate 25, a channel forming substrate 26 and an elastic plate 27. They are integrated through adhesion such that the nozzle plate 25 is provided on one side face of the channel forming substrate 26 and the elastic plate 27 is provided on the opposite side face thereof.

The nozzle plate 25 is a thin plate formed of stainless steel which has a plurality of nozzle orifices 28 provided in a row at a pitch corresponding to a dot formation density. In the embodiment, for example, 180 nozzle orifices are provided in a row, and two nozzle rows are arranged sideways.

The channel forming substrate 26 is a plate-shaped member in which a plurality of pressure chambers 33 are formed so as to be associated with the respective nozzle orifices 28, while being divided by partition walls is formed in such a state that a space to be the pressure chamber 33 is divided by a partition wall. Further, a common ink reservoir 31 (see FIG. 8) and ink supply ports each of which is communicates the associated pressure chamber 33 with the common ink reservoir 31 are formed therein as hollowed spaces. The channel forming substrate 26 according to the embodiment is fabricated by etching a silicon wafer.

The pressure chamber 33 is formed to be an elongated chamber in a direction orthogonal to the direction in which the nozzle orifices 28 are arranged in a row. The ink supply port 32 is formed to be a constricted portion having a small passage width communicating between the pressure chamber 33 and the common ink reservoir 31. Moreover, the common ink reservoir 31 serves to supply an ink stored in an ink cartridge (not shown) to each of the pressure chambers 33.

The elastic plate 27 is a composite plate member having a double structure which is obtained by laminating a resin film 35 such as PPS (polyphenylene sulfide) on a support plate 34 formed of metal such as stainless steel, and serves as a diaphragm portion for sealing one of the open faces of the pressure chamber 33 and also serves as a compliance portion for sealing one of the open faces of the common ink reservoir 31. As shown in FIG. 6, the support plate 34 in a portion serving as the diaphragm portion, that is, a portion corresponding to the pressure chamber 33 is subjected to etching to remove annularly, thereby forming the island portion 24 for bonding the distal end of the free end portion 22 of the piezoelectric vibrator 20. The island portion 24 has the shape of an elongated block in a direction orthogonal to the direction of the arrangement of the nozzle orifices 28 in the same manner as the planar shape of the pressure chamber 33. The resin film 35 provided around the island portion 24 serves as an elastic film. Referring to the portion serving as the compliance portion, that is, the portion corresponding to the common ink reservoir 31, moreover, the support plate 34 portion is removed by the etching to leave only the resin film 35.

Referring to the diaphragm portion, the island portion 24 is provided and the free end portion 22 of the piezoelectric vibrator 20 is bonded to the island portion 24 in the embodiment while the free end portion 22 may be directly bonded to the face of the resin film 35. In this case, the bonding portion in the resin film 35 to the free end portion 22 acts as a vibrator bonding portion in the invention. Moreover, while adhesion is suitably used for the bond of the piezoelectric vibrator 20 and the island portion 24 because of easiness and convenience, it is not restricted but brazing (for example, soldering) may be used.

Figure 7:
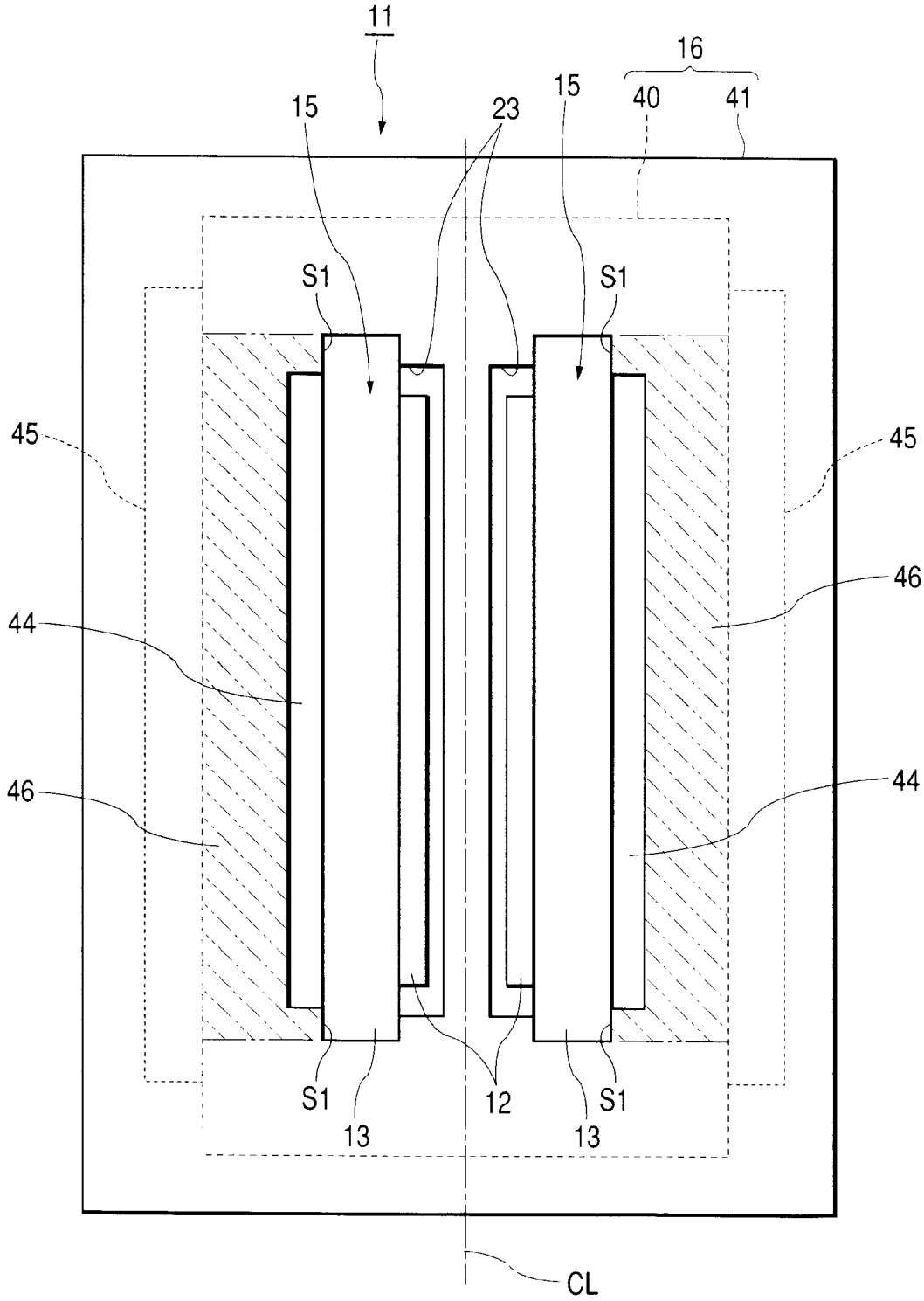
FIG. 7 is a plan view showing the recording head.
Figure 9:
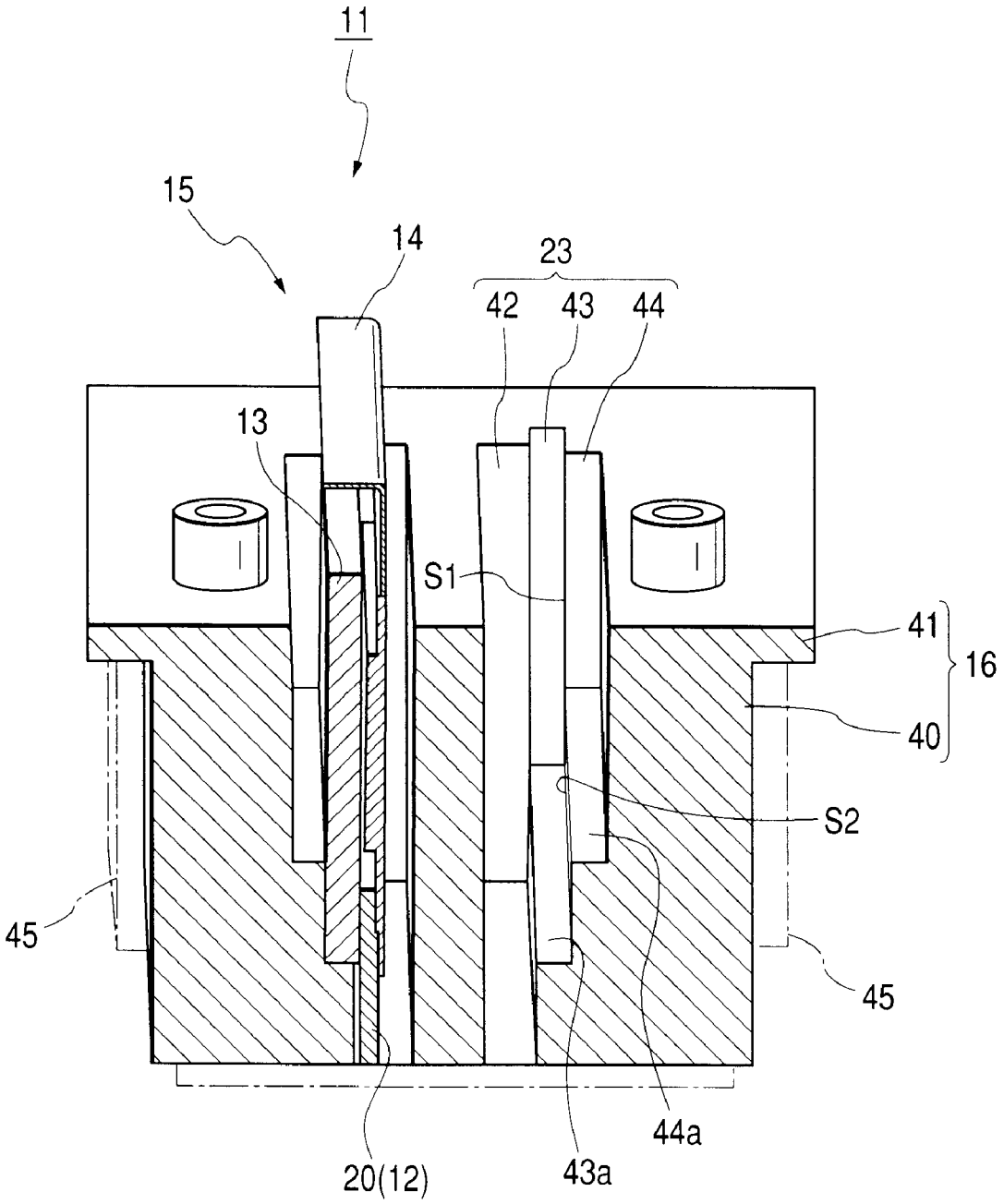
FIG. 9 is a partial section view showing the recording head.

Next, the case 16 will be described. As shown in FIGS. 7 to 9, the case 16 is a member formed of resin which is schematically constituted by a block-shaped main body 40 and a flange portion 41 extended from a proximal end of the main body 40 laterally. For the resin constituting the case 16, a thermosetting resin is suitably used because a molding property is excellent, high dimensional precision can be obtained and a necessary rigidity can also be acquired. In the embodiment, the case 16 is formed of epoxy resin.

As shown in FIG. 7, the main body 40 is formed to have an almost rectangular shape as seen from the flange portion 41 side, that is, the proximal end side. The main body 40 is provided with a housing space 23 capable of accommodating the vibrator unit 15. The housing space 23 is so formed as to communicate the distal end face of the main body 40 with the proximal end face thereof. In other words, the housing space 23 is formed as a hollowed space penetrating from a distal end side opening 23B to a proximal end side opening 23A in the height direction of the case 16. The housing space 23 is provided for each vibrator unit 15. For example, the recording head 11 according to the embodiment has two nozzle rows. Each nozzle row is provided with one vibrator unit 15. Therefore, two housing spaces 23 are provided sideways. More specifically; each housing space 23 is formed in positions which are laterally symmetrical with respect to a center line CL in the direction of the short side of the main body 40.

The housing space 23 is a continuous space including a first housing space 42 in which the piezoelectric vibrator row 12 is inserted, a second housing space 43 in which the fixation base 13 is inserted, and a relief concave portion 44 for forming a non-bonding region situated in the rear face portion of the fixation base 13 which is inserted into the second housing space 43.

The first housing space 42 has a flat and rectangular opening which is long in the direction of a long side of the attachment face (proximal end face) of the case 16 and is short in the direction of a short side of the attachment face. The first housing space 42 is continuously formed in the height direction of the case 16 from the distal end face of the case 16 to the attachment face. A long-side opening width of the first housing space 42 is determined to be slightly greater than a length of the piezoelectric vibrator row 12 in the direction in which the piezoelectric vibrators 20 are arranged, and a short-side opening width is determined to be a double of the thickness of each piezoelectric vibrator 20.

The second housing space 43 has a rectangular opening shape which is long in the direction of the long side of the attachment face and is short in the direction of the short side of the attachment face. The second housing space 43 extends from the attachment face to a position which is closer to the attachment face than the distal end face of the case 16. More specifically, a bottom face 43*a* of the second housing space 43 is provided in a position closer to the attachment face by a length which is slightly smaller than the length of the free end portion 22 of the piezoelectric vibrator 20 from the distal end face of the case 16. A long-side opening width of the second housing space 43 is determined to be almost equal to the width of the fixation base 13, and is slightly greater than the long-side opening length of the first housing space 42. Moreover, a short-side opening width of the second housing space 43 is determined to be almost equal to the thickness of the fixation base 13, more specifically, to be slightly smaller than the thickness of the fixation base 13.

The second housing space 43 is provided on the outside of the first housing space 42, that is, the side positioned apart from the center line CL in while communicating with the first housing space 42. The wall face defining the second housing space 43 acts as a bonding face to which the fixation base 13 of the vibrator unit 15 is bonded as will be described below. In the main body 40, accordingly, a portion positioned on the outside of the wall face, that is, a portion shown in hatching of a two-dotted line in FIG. 7 serves as a non-bonded wall portion 46.

Moreover, since the centers in a longitudinal direction of the openings in the second housing space 43 and the first housing space 42 are aligned with each other, both ends in the longitudinal direction of the opening of the second housing space 43 are outwardly protruded in comparison with both ends of the first housing space 42. In other words, the second housing space 43 is formed as a groove in the case 16 so as to define the protruded lateral ends.

The relief concave portion 44 has a rectangular opening shape which is long in the direction of the long side of the attachment face, and is short in the direction of the short side of the attachment face. The relief concave portion 44 extends from the attachment face to a position which is slightly closer to the attachment face than the bottom face 43*a* of the second housing space 43. More specifically, a bottom face 44*a* of the relieve concave portion 44 is positioned between a position at which is a half of a length in the height direction of the case 16 and a position at which is slightly closer to the attachment face than the bottom face 43*a* of the second housing space 43. The long-side opening width of the relieve concave portion 44 is determined to be slightly smaller than the long-side opening width of the second housing space 43, and is almost equal to the long-side opening width of the first housing space 42. Moreover, the short-side opening width of the relieve concave portion 44 is determined such that a sufficient clearance can be formed with respect to the back face of the fixation base 13, and is almost equal to the short-side opening width of the second housing space 43.

The relief concave portion 44 is provided on the outside of the second housing space 43 (the side positioned apart from the center line CL) while communicating with the second housing space 43. In other words, the relief concave portion 44 is fabricated by recessing or retracting backward most of the face of the non-bonded wall portion 46 in the thickness direction of the fixation base 13. For this reason, a region in which the relief concave portion 44 on the internal wall of the case is provided acts as a non-bonding area which is apart from the fixation base 13. Accordingly, the bonding face is formed by regions S1 defined by the relief concave portion 44 (see FIGS. 7 and 9) and a region S2 defined by the second housing space 43 (see FIG. 8).

The regions S1 are determined to be a portion having a very small width (approximately 0.5 mm). Moreover, the region S2 is a step wall face to be formed by a step of the bottom face 43*a* of the second housing space 43 and the bottom face 44*a* of the relief concave portion 44. The height dimension of the region S2 is approximately 2 to 3 mm. In connection with the height direction of the case 16, the region S2 is provided in a region corresponding to the bonding region of the fixed end portions 21 of the piezoelectric vibrators 20 and the fixation base 13 in the vibrator unit 15 (more specifically, the region S2 opposed at least a part of the bonding region of the fixed end portions 21). In other words, the region S2 is determined to a position and an area which are necessarily required to receive reaction force with the motion of the piezoelectric vibrator 20.

In the embodiment, moreover, the bottom face 43*a* of the second housing space 43 also serves as the bonding region of the fixation base 13 (the region S3) in addition to the bonding regions S1 and S2. In other words, the distal end face of the fixation base 13 is bonded to the internal wall of the main body 40. A clearance formed between the bottom face 43*a* and the distal end face of the fixation base 13 is determined to 0.04 mm, for example, and has such a size as to obtain capillary force for fluidizing an influent adhesive.

In order to attach the vibrator unit 15 to the housing space 23 having such a structure, first of all, the adhesive is thinly applied onto the distal end face of the free end portion 22 of the piezoelectric vibrator 20. If the adhesive is applied, the fixation base 13 is held by a jig and the vibrator unit 15 is inserted from the proximal end side opening 23A of the housing space 23 in such an attitude that the free end portion 22 is first inserted. The distal end of the free end portion 22 is caused to face the distal end side opening 23B of the housing space 23 and is positioned in such a state as to abut on the face of the associated island portion 24. In this state, the bonding regions S1, S2 and S3 between the fixation base 13 and the internal wall of the case are filled with the adhesive. For example, the adhesive having a fluidity is injected into the side edge region S1 from the attachment face side of the case 16, and the influent adhesive is filled in the side edge region S1, the distal end side region S2 and the distal end face region S3 by utilizing the capillarity. If each bonding region is filled with the adhesive, the adhesive on the distal end of the free end portion 22 and the adhesive in the bonding region are cured. For example, the adhesives are left for a proper time in such a state that they are heated to a predetermined temperature. Consequently, the fixation base 13 is bonded to the internal wall of the case (the bonding regions), while the distal end of the free end portion 22 is bonded to the island portion 24.

Figure 16:
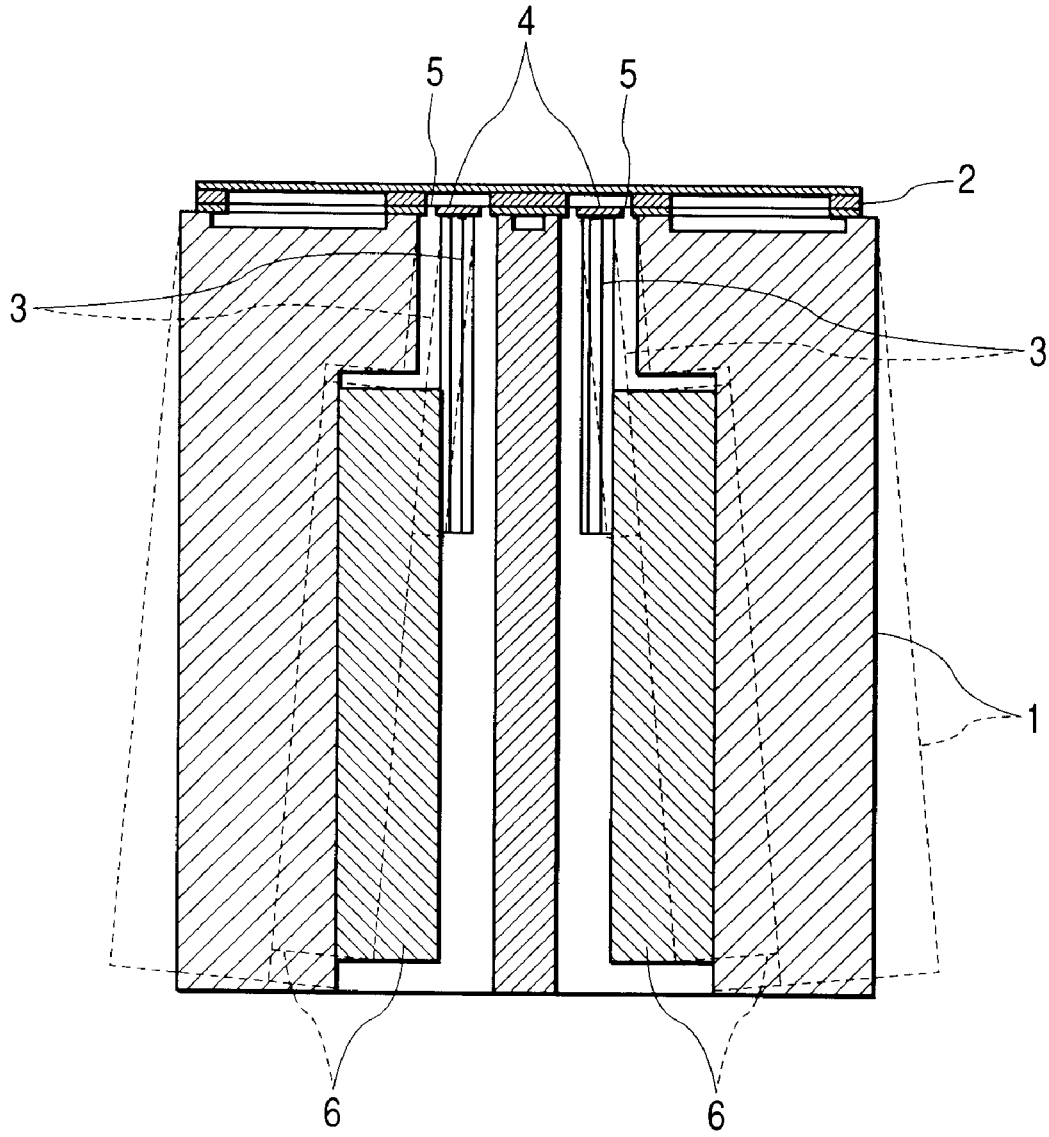
FIG. 16 is a section view illustrating the related recording head and the expansion state thereof.

Since the bottom face 43*a* is also used as a bonding region for the fixation base 13, reaction force generated by the deformation of the piezoelectric vibrator 20 and transmitted from the channel unit 17 to the main body 40 can be received by the fixation base 13. For this reason, the undesired vibration of the recording head 11 due to the deformation of the piezoelectric vibrator 20 can be more reduced in comparison with the case in which the distal end face of the fixation base 13 is provided apart from the main body 40 as shown in FIG. 16.

Moreover, a reinforcing plate 45 is provided on an outer peripheral face of the main body 40 so as to extend from the flange portion 41 to a position where opposes the, bonding region of the fixed end portions 21 of the piezoelectric vibrators 20 and the fixation base 13. Specifically, the reinforcing plate 45 extends to a position where is closer to the attachment face than the distal end face of the case 16. More specifically, the reinforcing plate 45 extends to a position where is closer to the attachment face than a distal end face of the fixation base 13. As shown in FIG. 7, the width of the reinforcing plate 45 is so determined as to be wide enough to cover the non-bonded wall portion 46.

The reinforcing plate 45 serves as a member for restricting the swell of the case 16 due to moisture absorption and serves to prevent the moisture absorbing case 16 from being swelled outward. For this reason, a plate member which is more difficult to be swelled due to the moisture absorption than the resin case 16 is used for the reinforcing plate 46. Moreover, the reinforcing plate 45 is provided in a region corresponding to the bonding region of the fixation base 13 and the internal wall of the case. In order to restrict the swell of the case 16, it is desirable that the rigidity of the reinforcing plate 45 should be equal to or higher than that of the fixation base 13.

Accordingly, a plate member formed of metal which is not swelled by the moisture absorption, has a high rigidity and can easily be processed is suitably used for the reinforcing plate 45. In the embodiment, a stainless steel plate to be a plate member formed of the same material as that of the fixation base 13 is used, and the thickness of the reinforcing plate 45 is determined to be equal to that of the fixation base 13. Thus, when a plate member formed of the same material is used for the reinforcing plate 45 and the fixation base 13, the material characteristics of the reinforcing plate 45 and the fixation base 13 are equal to each other. Consequently, a design can easily be carried out. Moreover, if the reinforcing plate 45 is formed of metal, the heat of the recording head 11 can be discharged efficiently to the outside.

If the reinforcing plate 45 is constituted by a material having a higher rigidity than that of the fixation base 13 (that is, a greater Young's modulus), the reinforcing plate 45 can be formed thinly. Therefore, it is advantageous in that the size of the recording head 11 can be reduced.

Moreover, while the reinforcing plate 45 is fixed to the main body 40 by adhesion, the reinforcing plate 45 can be fixed to the main body 40 by any method if possible. For example, the reinforcing plate 45 may be fixed by calking or may be held in a holding groove provided in the main body 40. Alternatively, the reinforcing plate 45 may be insert molded in the main body 40, that is, be non-bonded wall portion 46. In the case in which the reinforcing plate 45 is fixed by the adhesion, the adhesive of the reinforcing plate 45 can be cured at the step of curing the adhesive of the fixation base 13 so that the process can be simplified.

Next, description will be given to the advantages of the recording head 11 having the structure described above, more specifically, the advantages obtained when the recording head 11 is placed for a long time in very high humid environment.

Since the relief concave portion 44 is formed so that the non-bonded wall portion 46 is isolated from the fixation base 13 except for the bonding, regions S1, and the fixation base 13 is mainly bonded with the case 16 at the distal end side (the bonding region S2), even in a case where the non-bonded wall portion 46 is swelled outwardly due to the moisture absorption, the fixation base 13 is prevented from inclining together with the non-bonded wall portion 46. Accordingly, it is possible to prevent such a drawback that the bonding interface of the piezoelectric vibrator 20 and the island portion 24 is separated. As a result, the connecting reliability of the piezoelectric vibrator 20 can be enhanced.

Moreover, the bonding region S2 is provided in a region corresponding to the bonding region of the fixed end portions 21 of the piezoelectric vibrators 20 and the fixation base 13. Therefore, it is possible to maintain a region necessarily required for receiving reaction force generated by the motion of the piezoelectric vibrator 20. Consequently, the connecting reliability of the piezoelectric vibrator 20 can be enhanced without damaging the jetting characteristic of ink drops.

Furthermore, since a part of the outer wall of the case 16 is sandwiched by the reinforcing plate 45 and the fixation base 13 as shown in FIG. 8, it is possible to restrict the swelling of the sandwiched portion of the case 16.

Consequently, the proximal end portion of the case 16 is not expanded toward the side so that the fixation base 13 can be reliably prevented from inclining together with the non-bonded wall portion 46. Accordingly, it is possible to prevent mechanical stress from being applied to, the bonding interface of the piezoelectric vibrator 20 and the island portion 24 due to the inclination of the vibrator unit 15, and mechanical stress from being applied to the bonding interface of the resin film 35 and the island portion 24. Further, it is possible to prevent such a drawback that these bonding interfaces are separated. As a result, the connecting reliability of the piezoelectric vibrator 20 can be enhanced.

Moreover, since both the fixation base 13 and the reinforcing plate 45 are formed of metal (stainless steel) which does not absorb moisture, it is also possible to cause the non-bonded wall portion 46 to absorb moisture with difficulty.

Since the distal end of the reinforcing plate 45 is situated at a position where is closer to the attachment face than the distal end face of the case 16, the distal end portion of the case 16 is not restricted by the reinforcing plate 45. Therefore, this portion is permitted to expand outwards as indicated by the dashed line of FIG. 8. However, since the expanded portion is provided close to the bonding regions S2 and S3, the swelling less influences the inclination of the vibrator unit 15.

By allowing the distal end portion of the case to expand outward, the positional relationship between the channel unit 17 and the vibrator unit 15 in the height direction of the case 16 can be maintained even in the swelling is occurred.

Consequently, it is also possible to reliably prevent such a drawback that the channel unit 17 and the vibrator unit 15 are separated from each other in the height direction of the case 16 by the swelling of the case 16. Also in this respect, the connecting reliability of the piezoelectric vibrator 20 can be enhanced.

The reinforcing plate 45 may be extended to the position indicated as a dashed line L in FIG. 8 so that the distal end of the reinforcing plate 45 is aligned with the distal end face of the fixation base 13 in the height direction of the case 16, thereby covering a region corresponding to the bonding region of the fixation base 13 and the case 16.

Moreover, the reinforcing plate 45 may be configured to surround the side faces of the main body 40. With such a structure, the swelling of the case 16 can be more reliably prevented.

Figure 10:
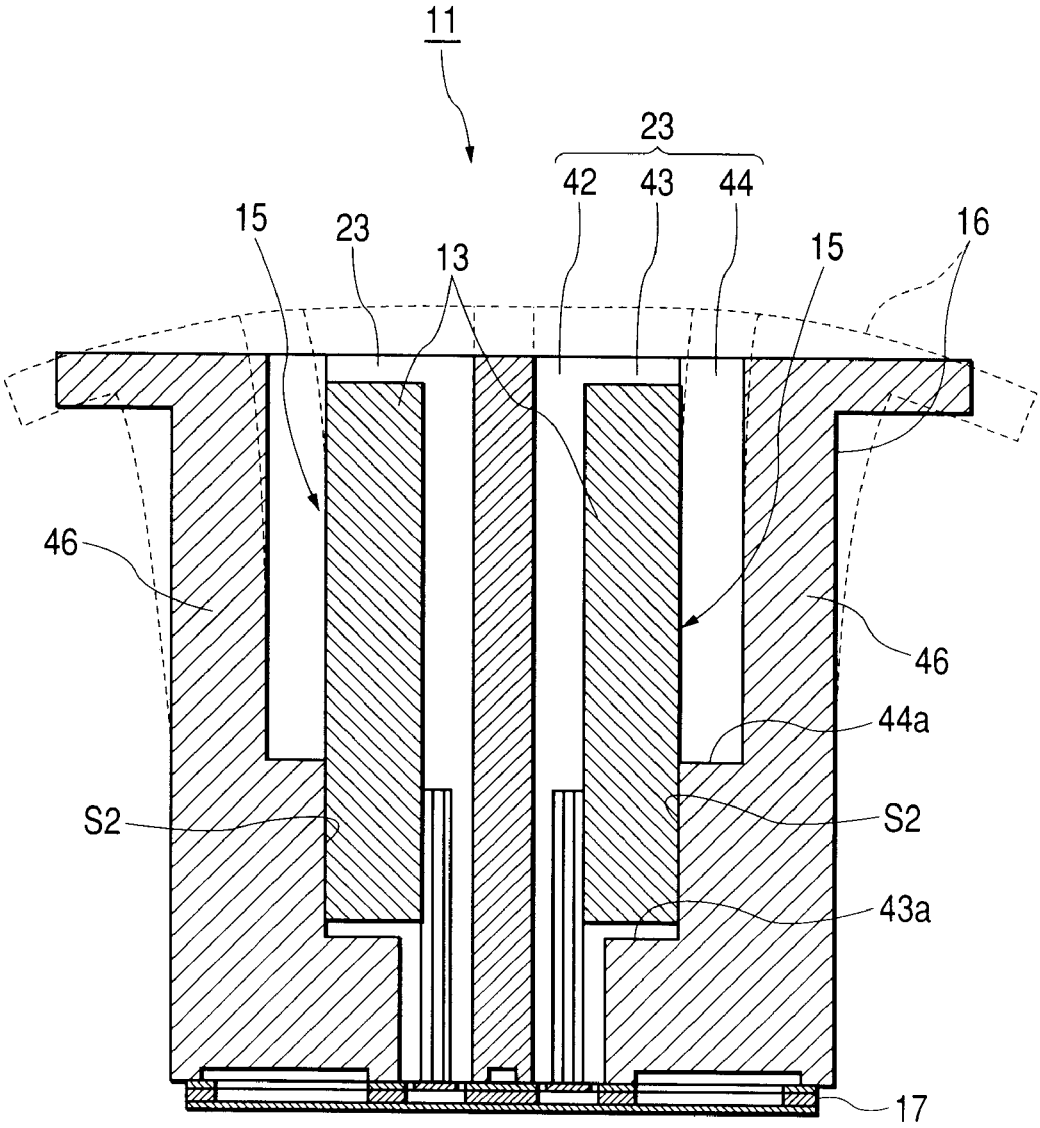
FIG. 10 is a section view illustrating a modified example of the recording head.

As shown in FIG. 10, moreover, it is also possible to employ such a structure that the reinforcing plate 45 is not provided but only the relief concave portion 44 is provided. Also in this configuration, the non-bonded wall portion 46 is substantially isolated from the fixation base 13, and the fixation base is bonded with the case 16 only at the distal end portion thereof which is closer to the channel unit 17. As shown in a dashed line, therefore, even if the case 16 is swelled outward, the fixation base 13 can be prevented from inclining together with the non-bonded wall portion 46 so that mechanical stress can be prevented from being applied to the bonding interface of the piezoelectric vibrator 20 and the island portion 24 due to the inclination of the vibrator unit 15.

The invention is not restricted to the above configuration. Next, a second embodiment of the invention will be described with reference to FIGS. 11 to 14.

Figure 11:
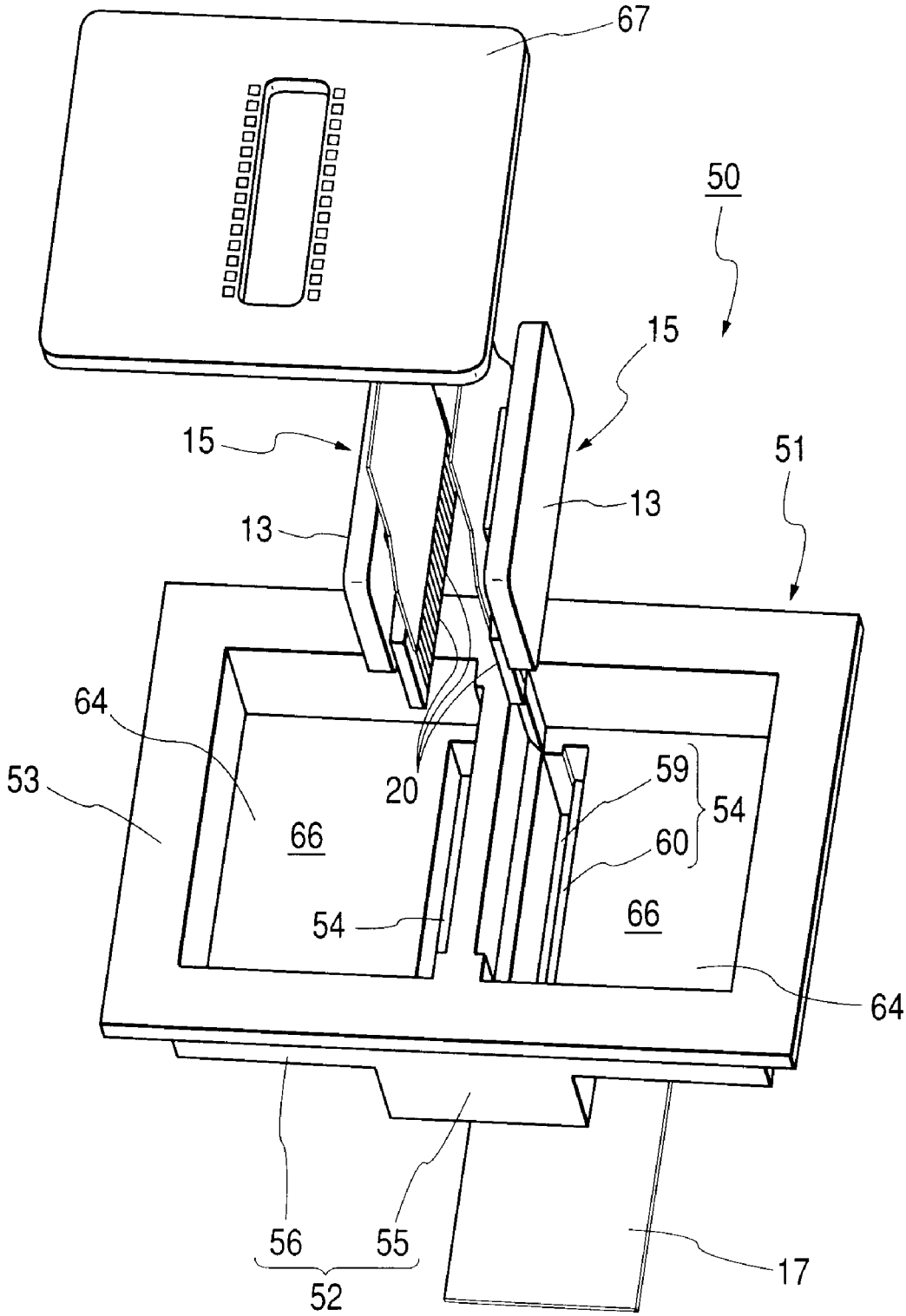
FIG. 11 is an exploded perspective view showing a recording head according to a second embodiment of the invention.
Figure 12:
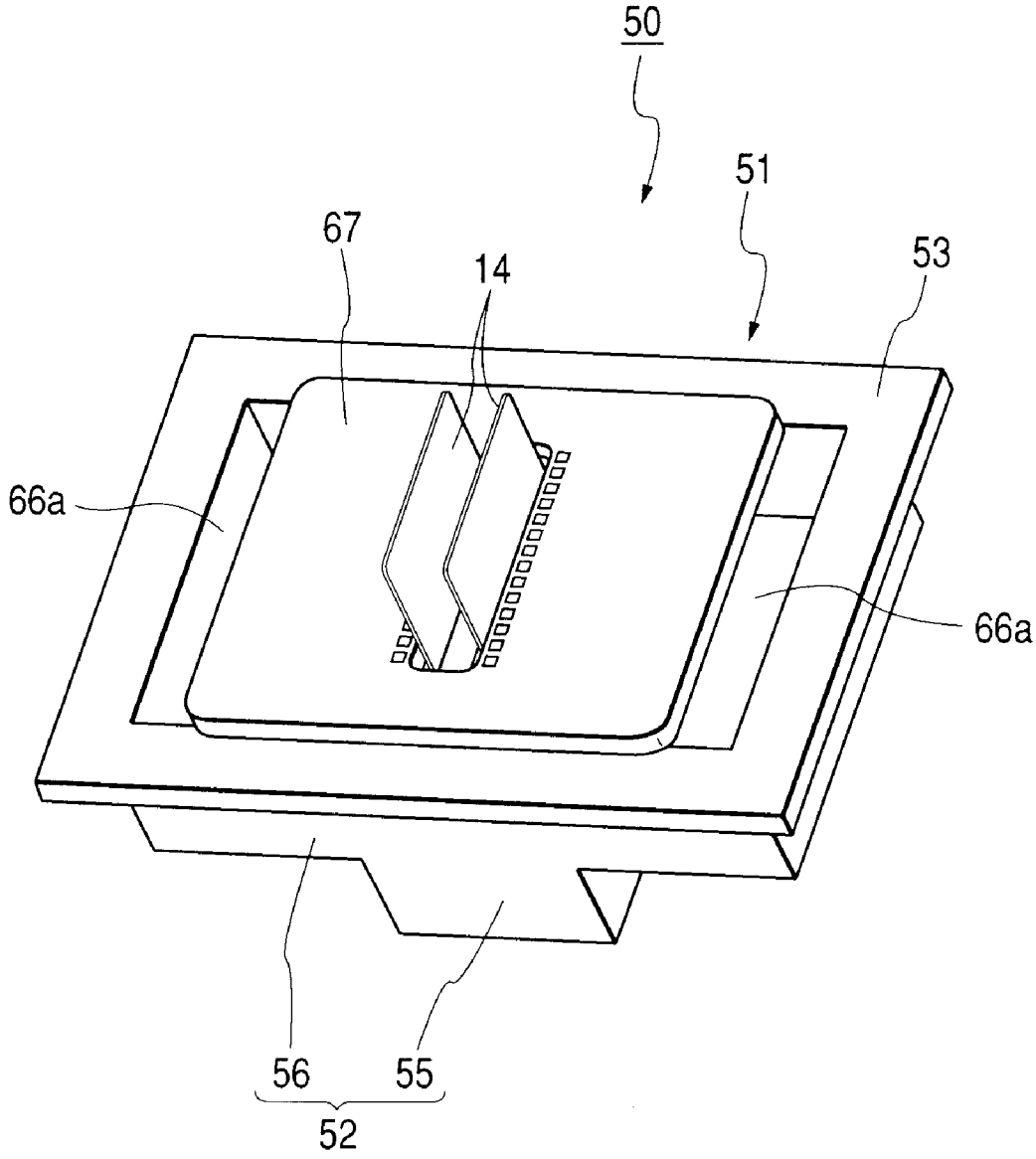
FIG. 12 is a perspective view showing the recording head of FIG. 11, as seen from the flange portion side.

As shown in FIGS. 11 and 12, a recording head 50 according to the second embodiment comprises a vibrator unit 15; a case 51 capable of accommodating the vibrator unit 15; and a channel unit 17 to be bonded to a distal end face of the case 51. In the recording head 50 according to the embodiment, the shape of the case 51 is mainly different from that of the first embodiment. The difference will be mainly described below.

In the second embodiment, the same members as those in the first embodiment have the same reference numerals and description thereof will be omitted.

Figure 13:
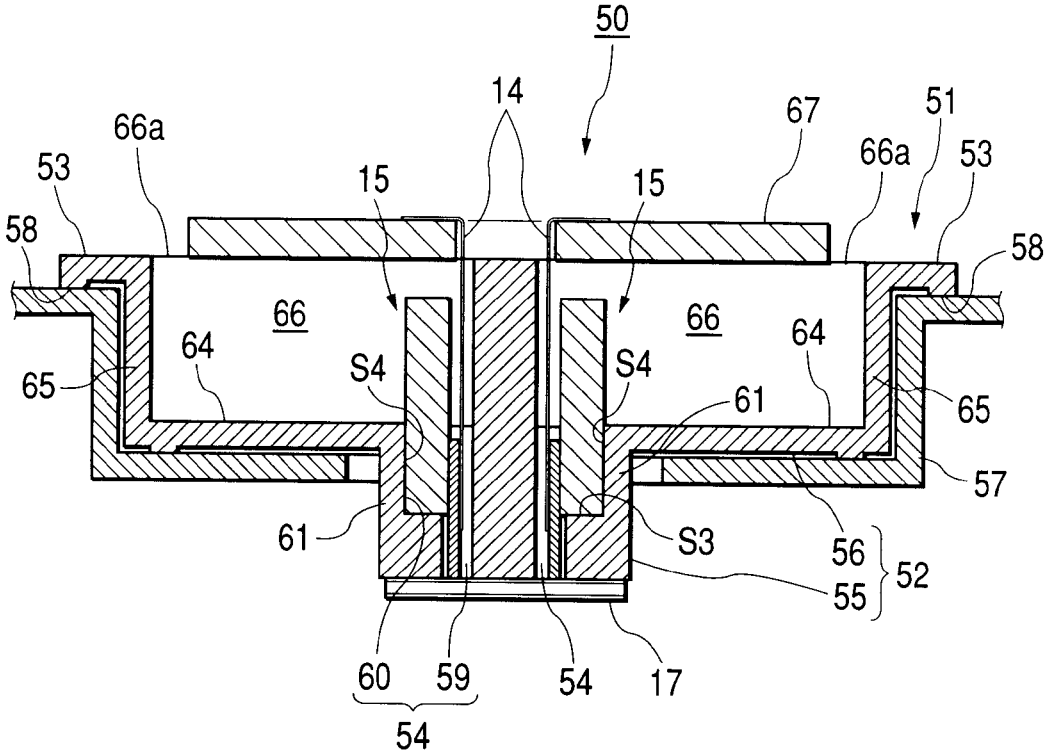
FIG. 13 is a section view illustrating the recording head of FIG. 11.

As shown in FIG. 13, the case 51 is roughly constituted by a main body 52 and a flange portion 53 and is formed of epoxy resin to be a kind of thermosetting resin. The main body 52 is constituted by a distal end portion 55 provided with a housing space 54 and a box-shaped proximal end portion 56 opened on an attachment face. The proximal end portion 56 is constituted by a bottom plate portion 64 extended laterally and an upright wall portion 65 upright from the outside edge portion of the bottom plate portion 64 toward the attachment face side of the case 51. Moreover, the flange portion 53 is extended from the proximal end of the upright wall portion 65 laterally. A positioning projection 58 to abut on a carriage member 57 is formed on the lower face of the flange portion 53 (that is, a face on the channel unit 17 side). The positioning projection 58 serves as a positioning member and is constituted by a flat and circular projection, for example. Thus, the positioning projection 58 is provided on the flange portion 53 and a distance from the flange portion 53 on one of sides to the flange portion 53 on the opposite side can be set to be large by causing the positioning projection 58 to abut on the carriage member 57, and positional precision in a horizontal direction can be enhanced when attaching the recording head 50 to the carriage member 57.

The distal end portion 55 of the main body 52 has the shape of a rectangular parallelepiped which has a height slightly greater than the length of each piezoelectric vibrator 20, and the distal end face having the channel unit 17 bonded thereto is a size larger than the channel unit 17. Moreover, the housing space 54 is a through hole portion which is continuously formed to penetrate the inside of the distal end portion 55 in the height direction of the case 51. The recording head 50 according to the embodiment also has two nozzle rows and each nozzle row is provided with one vibrator unit 15. Therefore, two housing spaces 54 are provided sideways.

The housing space 54 is a continuous space including a first housing space 59 in which a piezoelectric vibrator row 12 is to be inserted and a second housing space 60 in which a fixation base 13 is to be inserted. The first housing space 59 has a flat and rectangular opening which is long in the direction of a long side of the distal end portion 55 and is short in the direction of a short side of the distal end portion 55. The first housing space 59 is formed continuously in the height direction of the case 51 so as to extend from the distal end face of the distal end portion 55 to the bottom plate portion 64 of the proximal end portion 56. The second housing space 60 also has a rectangular opening shape which is long in the direction of a long side of the distal end portion 55 and is short in the direction of a short side of the distal end portion 55. The second housing space 60 is formed continuously so as to extend from the bottom face of the proximal end portion 56 to a position in the distal end portion 55 which is slightly closer to the bottom plate portion 64 than the distal end face of the distal end portion 55.

The wall face defining the second housing space 60 also acts as a bonding face S4 to which the fixation base 13 of the vibrator unit 15 is bonded. Accordingly, a wall portion of the main body 52 corresponding to the bonding face S4 serves as a base-bonded wall portion 61.

In order to attach the vibrator unit 15 to the housing space 54 having such a structure, first of all, an adhesive is thinly applied onto the distal end face of a free end portion 22 of the piezoelectric vibrator 20, and the vibrator unit 15 is inserted in the housing space 54 such that the free end portion 22 is first inserted. Then, the distal end of the free end portion 22 is positioned in such a state as to abut on the face of a corresponding island portion 24 and bonding faces S3 and S4 provided between the fixation base 13 and the internal wall of the case are filled with the adhesive. Consequently, the distal end portion of the fixation base 13 is bonded to the internal wall of the case and the distal end of the free end portion 22 is bonded to the island portion 24.

In the proximal end portion 56, a space 66 is defined by the bottom plate portion 64 and the upright wall portion 65. The opening area of the space 66 is defined depending on the size of the bottom plate portion 64 and a volume is defined by the size of the bottom plate portion 64 and the height of the upright wall portion 65. The inside of the space 66 can be used for various purposes, for example, accommodates the components of the recording head 50.

In the embodiment, the space 66 is used as a space for accommodating the upper half portion of the vibrator unit 15 and is also used as a heat radiating space for discharging heat from the piezoelectric vibrator 20. For this reason, the height of the upright wall portion 65 is determined to be slightly greater than that of the fixation base 13 which is disposed state. As shown in FIGS. 12 and 13, moreover, the opening area of the space 66 is determined to be larger than the area of a circuit board 67 provided on the attachment face side of the case 51, and a clearance 66*a* which is not covered with the circuit board 67 but communicates with the outside is formed on the opening of the space 66. With such a structure, the heat generated from the piezoelectric vibrator 20 is transmitted through the fixation base 13 and is discharged into the space 66 of the proximal end portion 56, and furthermore, is discharged to the outside of the case 51 through the clearance 66*a* with the circuit board 67.

Also in the second embodiment having such a structure, it is possible to prevent the vibrator unit 15 from inclining due to the swell of the case 51 and to enhance the connecting reliability of the piezoelectric vibrator 20.

More specifically, when the case 51 is placed for a tong time in very high humid environment, it absorbs a moisture and is swelled. However, since the proximal end portion 56 serving as a non-bonded wall portion is isolated from the fixation base 13, the vibrator unit 15 can be prevented from inclining.

Moreover, the bottom plate portion 64 extending laterally acts so as to restrict the inclination of the fixation base 13 due to the swelling of the case 51. Specifically, although the bottom portion 64 is also swelled due to the moisture absorption, the swelling restricts the inclination of the fixation base 13 because the swelling direction of the bottom plate portion 64 is opposite to the inclining direction.

In the embodiment furthermore, the space 66 is formed by the bottom plate portion 64 and the upright wall portion 65. Therefore, the components of the recording head 50 can be provided in the space 66. Consequently, the degree of freedom for the design of the recording head 50 can be increased.

Figure 14:
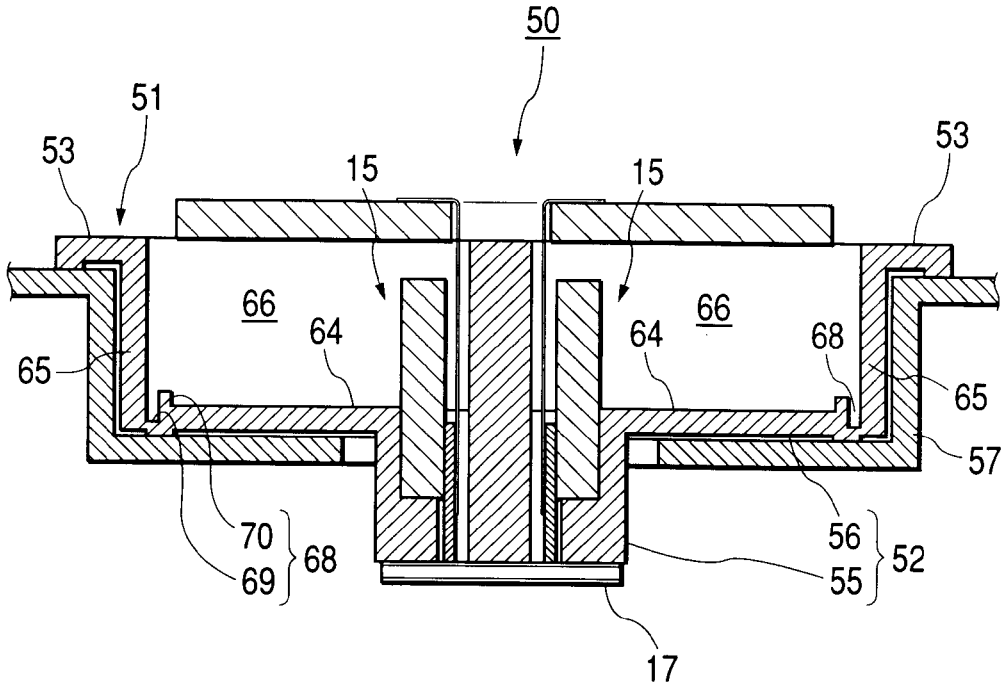
FIG. 14 is a section view illustrating a modified example of the recording head of FIG. 11.
Figure 15:
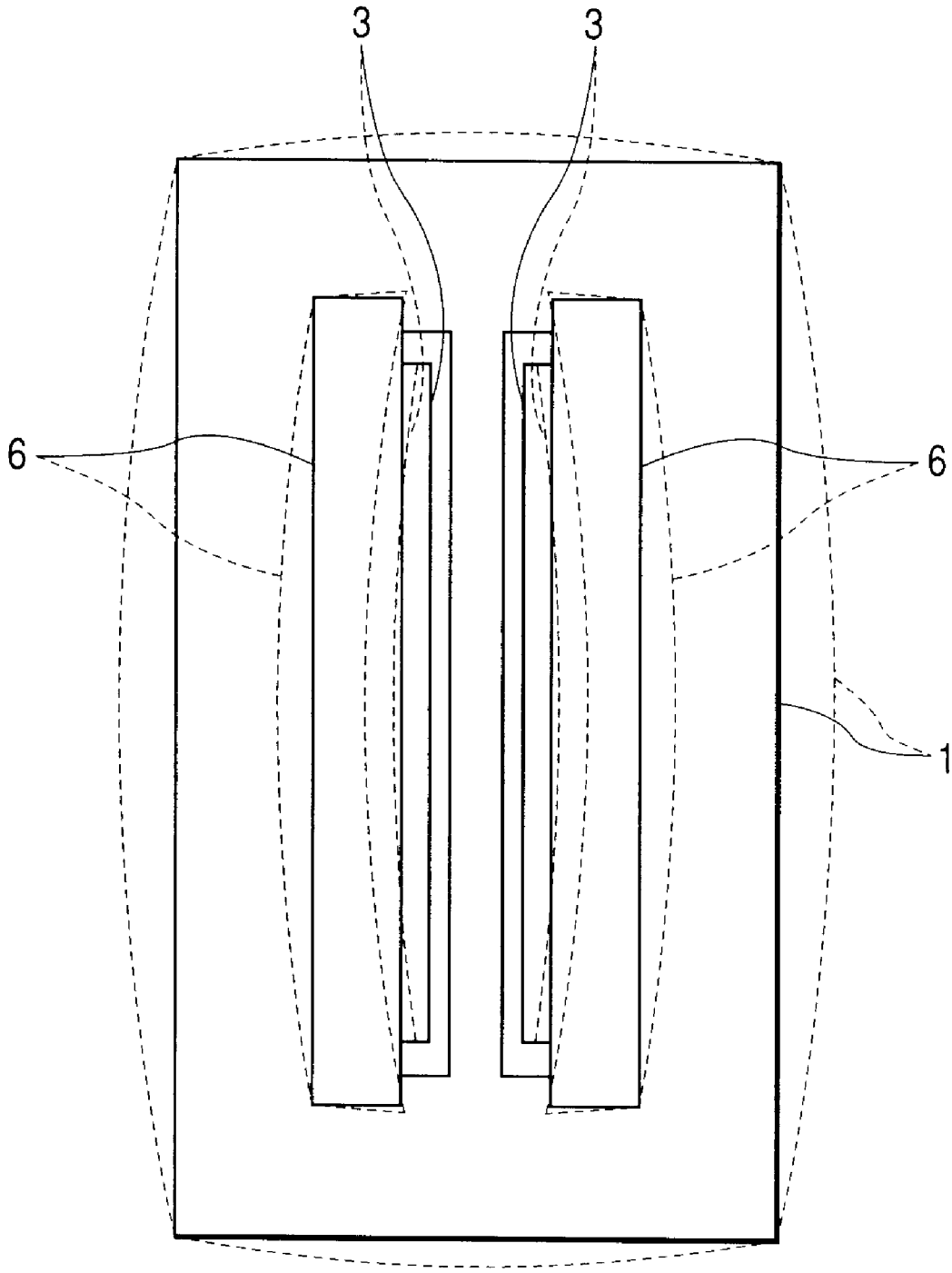
FIG. 15 is a plan view illustrating a related recording head and an expansion state thereof.

As shown in FIG. 14, moreover, an ink holding groove 68 capable of holding an ink may be provided in the space 66, specifically, in the boundary portion of the bottom plate portion 64 and the upright wall portion 65.

In a recording apparatus comprising the ink jet recording head 50 of this kind, there is a problem in that an ink drop is caused to fly in a very small amount and is therefore changed into mist. The ink mist floats in the apparatus. Therefore, if the ink mist sticks to a carriage or a housing, it might be changed into a large ink drop. The large ink drop thus generated might enter a clearance between the recording head 50 and the carriage by capillary force, thereby contaminating and damaging the recording head 50.

When the ink holding groove 68 is provided in the boundary portion of the bottom plate portion 64 and the upright wall portion 65, the ink entering from the outside and flowing down through the upright wall portion 65 can be held in the ink holding groove 68. Consequently, it is possible to prevent such a drawback that the ink reaches the vibrator unit 15.

Referring to the ink holding groove 68, the inside edge portion of the bottom plate portion 64 is scraped in the direction of a thickness to provide a concave groove 69 and a rib 70 is protruded to form a relatively deep groove in FIG. 14, while only the concave groove 69 may be provided or only the rib 70 may be protruded.

The invention is not restricted to the embodiments described above but may be variously changed based on the appended claims.

For example, while the non-bonded wall portion 46 is concaved to partially bond the fixation base 13 in the first embodiment, the thickness of the fixation base 13 in the portion corresponding to the bonding region may be set to be greater than that of other portions to partially bond the fixation base 13. In the case in which the non-bonded wall portion 46 is concaved to form a non-bonding region to the fixation base 13, the relief concave portion 44 can easily be fabricated by molding.

In the recording head 11 having three or more vibrator units 15, moreover, a partitioning wall portion formed between the housing spaces 23 also serves as the base-bonded wall portion. In such a structure that the reinforcing plate 45 is provided, the same advantageous effects as described in the first embodiment can be obtained by insert molding the reinforcing plate 45 in the partitioning wall portion.

What is claimed is:

1. An ink jet recording head, comprising:

a vibrator unit, in which at least one piezoelectric vibrator is fixed on a base member in a cantilevered manner, such that a first region of the piezoelectric vibrator is fixed on a first face of the base member; and a resin case, formed with a housing space extending through a first end face to a second end face thereof, the housing space including:

a first housing part, which opens to the first end face of the case, in which the piezoelectric vibrator is housed;

a second housing part, which continues to the first housing part, the second housing part defined by a first inner face extending in a first direction which is parallel with an extending direction of the piezoelectric vibrator, on which a first part of a second face of the base member which is opposite to the first face of the base member is bonded, and a second inner face of the second housing extending in a second direction which is perpendicular to the first direction, on which a part of a third face of the base member which connects the first face of the base member and the first part of the second face of the base member is bonded; and a third housing part, which continues to the second housing part, the third housing part being isolated from a part of the base member which includes a second part of the second face, wherein the second part of the second face of the base member is larger than the first part of the second face of the base member.

2. The ink jet recording head as set forth in claim 1, wherein the first part of the second face of the base member opposes to at least the first region of the piezoelectric vibrator.

3. The inkjet recording head as set forth in claim 1, wherein inner wall faces of the case defining the third housing part is not bonded to the base member.

4. The ink jet recording head as set forth in claim 1, wherein:

the case includes a flange member extending from the second end face thereof in the second direction; and a positioning member is formed on a distal end portion of the flange member, which is abutted on a carriage member on which the recording head is mounted.

5. The ink jet recording head as set forth in claim 1, further comprising a channel unit which is provided on the first end face of the case such that free end face of the piezoelectric member is bonded thereon.

6. The ink jet recording head as set forth in claim 1, wherein the case is made of thermosetting resin.

7. The ink jet recording head as set forth in claim 1, wherein a width of the first housing part is double a thickness of the piezoelectric vibrator.

8. The ink jet recording head as set forth in claim 1, wherein a width of the second housing part is smaller than a thickness of the base member.

9. The ink jet recording head as set forth in claim 1, further comprising a reinforcing plate member surrounding an outer wall of the case.

10. An ink jet recording head, comprising:

a vibrator unit, in which at least one piezoelectric vibrator is fixed on a base member in a cantilevered manner, such that a first region of the piezoelectric vibrator is fixed on a first face of the base member; and a resin case, formed with a housing space extending through a first end face to a second end face thereof, the housing space including:

a first housing part, which opens to the first end face of the case, in which the piezoelectric vibrator is housed;

a second housing part, which continues to the first housing part, the second housing part defined by a first inner face extending in a first direction which is parallel with an extending direction of the piezoelectric vibrator, on which a first part of a second face of the base member which is opposite to the first face of the base member is bonded, and a second inner face of the second housing extending in a second direction which is perpendicular to the first direction, on which a part of a third face of the base member which connects the first face of the base member and the first part of the second face of the base member is bonded; and a third housing part, which continues to the second housing part, the third housing part being isolated from a part of the base member which includes a second part of the second face, wherein inner wall faces of the case defining the third housing part is not bonded to the base member, and wherein the third housing part is defined by a third inner face extending from a boundary of the first part and the second part of the second face of the base member in the second direction, and a fourth inner face extending in the first direction to the second end face of the case.

11. An ink jet recording head, comprising:

a vibrator unit, in which at least one piezoelectric vibrator is fixed on a base member in a cantilevered manner, such that a first region of the piezoelectric vibrator is fixed on a first face of the base member; and a resin case, formed with a housing space extending through a first end face to a second end face thereof, the housing space including:

a first housing part, which opens to the first end face of the case, in which the piezoelectric vibrator is housed;

a second housing part, which continues to the first housing part, the second housing part defined by a first inner face extending in a first direction which is parallel with an extending direction of the piezoelectric vibrator, on which a first part of a second face of the base member which is opposite to the first face of the base member is bonded, and a second inner face of the second housing extending in a second direction which is perpendicular to the first direction, on which a part of a third face of the base member which connects the first face of the base member and the first part of the second face of the base member is bonded;

a third housing part, which continues to the second housing part, the third housing part being isolated from a part of the base member which includes a second part of the second face; and a reinforcing plate member provided on a first part of an outer wall of the case, the first part of the outer wall being a part opposing to at least the third housing part.

12. The ink jet recording head as set forth in claim 10, further comprising a circuit board mounted on the second end face of the case, wherein an area defined by the third inner wall face is larger than a size of the circuit board.

13. The ink jet recording head as set forth in claim 10, wherein a groove for holding ink therein is formed at a boundary of the third inner wall face and the fourth inner wall face.

14. The ink jet recording head as set forth in claim 11, wherein the reinforcing plate member extends so as not to extend to the first end face of the case.

15. The ink jet recording head as set forth in claim 14, wherein the reinforcing plate member extends to a position opposing to the second inner wall face of the case.

16. The ink jet recording head as set forth in claim 11, wherein a Young's modulus of the reinforcing plate member is higher than a Young's modulus of the base member.

17. The ink jet recording head as set forth in claim 11, wherein the base member and the reinforcing plate member are made of the same material.

18. The ink jet recording head as set forth in claim 11, wherein the reinforcing plate member is made of metal.

19. The ink jet recording head as set forth in claim 18, wherein the reinforcing plate member is made of stainless steel.

20. The ink jet recording head as set forth in claim 17, wherein a thickness of the reinforcing plate member is identical with a thickness of the base member.

* * * * *